US005256459A

United States Patent [19]

Carlson

[11] Patent Number: 5,256,459

[45] Date of Patent: Oct. 26, 1993

[54] WOUND PRINTING SLEEVE

[75] Inventor: James R. Carlson, Racine, Wis.

[73] Assignee: American Roller Company, Union Grove, Wis.

[21] Appl. No.: 900,510

[22] Filed: Jun. 17, 1992

Related U.S. Application Data

[63] Continuation of Ser. No. 695,191, May 3, 1991, abandoned.

[51] Int. Cl.[5] ..... B41F 27/10; B41F 13/10

[52] U.S. Cl. ..... 428/36.3; 428/34.5; 428/36.9; 428/107; 428/222; 428/371; 101/282.1; 101/368; 101/375

[58] Field of Search ..... 428/34.5, 36.3, 36.9, 428/107, 113, 222, 292, 332, 371, 377, 392; 101/382.1, 368, 375; 156/149, 176, 173

[56] References Cited

U.S. PATENT DOCUMENTS

| | | | |
|---|---|---|---|
| 3,089,265 | 5/1978 | White et al. | 101/375 |
| 3,107,698 | 10/1963 | Baker et al. | 428/36.3 |
| 3,146,709 | 9/1964 | Bass et al. | 101/375 |
| 3,978,254 | 8/1976 | Hoexter et al. | 428/36 |
| 4,030,415 | 6/1977 | Fellows | 101/382 |
| 4,119,032 | 10/1978 | Hollis | 101/216 |
| 4,137,351 | 1/1979 | Clodfelter et al. | 428/113 |
| 4,144,812 | 3/1979 | Julian | 101/382 |
| 4,144,813 | 3/1979 | Julian | 101/382 |
| 4,381,709 | 5/1983 | Katz | 101/375 |
| 4,554,040 | 11/1985 | van der Velden | 156/215 |
| 4,794,858 | 1/1989 | Katz | 101/375 |
| 4,903,597 | 2/1990 | Hoage et al. | 101/401 |

*Primary Examiner*—Ellis P. Robinson
*Assistant Examiner*—Charles R. Nold
*Attorney, Agent, or Firm*—Quarles & Brady

[57] ABSTRACT

A printing sleeve comprises a cylindrical tube of polymeric material reinforced with overlapping, closely touching windings of fibrous reinforcing material with at least one winding extending in each direction. The windings are wound in a helical pattern at a wind angle of about 40°.

4 Claims, 1 Drawing Sheet

WOUND PRINTING SLEEVE

This application is a continuation of application Ser. No. 07/695,191, filed May 3, 1991, now abandoned.

FIELD OF THE INVENTION

This invention relates to printing sleeves which are readily mountable onto and dismountable from printing cylinders. More particularly, it relates to a wound printing sleeve which can be readily mounted and dismounted from a printing cylinder by expanding the sleeve with pressurized gas.

BACKGROUND OF THE INVENTION

In the past, flexible printing plates were mounted directly onto the outer surface of a printing cylinder and used for the printing of ink images on a printing medium. However, because the plates could not be easily moved from one cylinder to another, a separate printing cylinder was often needed for each plate.

To overcome the need to use multiple printing cylinders, printing sleeves were developed on which the plates could be mounted. The sleeves are mounted onto a printing cylinder with the assistance of a pressurized gas, such as compressed air, which is passed in a substantially radial direction through holes in a printing cylinder to expand the sleeve to a limited extent to assist the mounting of the sleeve on the cylinder. When the gas flow stops the sleeve contracts and engages the cylinder. The gas pressure is once again used when it is desired to dismount the sleeve from the cylinder.

An early patent which describes such a printing sleeve and the use of pressurized gas for the mounting and dismounting of the sleeve is the Bass et al. U.S. Pat. No. 3,146,709. The patent discloses a printing sleeve, which is formed, in part, of helically wound paper.

The recently issued Hoage U.S. Pat. No. 4,903,597 describes some of the problems encountered with the early wound tubes.

Some of the prior art wound sleeves apparently did not effectively expand unless high pressure air, substantially higher than the 50–100 psi air generally available in production facilities, was radially conveyed between the sleeve and the printing cylinder to facilitate the mounting and dismounting operation. The expandability problem was believed to be due to the thickness of the sleeve walls and the wound construction. In addition, it was believed that wound sleeves also had leakage problems inherent in their design.

The Hoage patent also describes prior art printing sleeves which are made of a metallic material. The metallic sleeves also are believed to require a thin wall to be readily expandable, i.e., thicknesses of up to only about 0.005". Unfortunately, the required thin wall of the metallic sleeves can cause durability problems.

As a solution to the problem of prior art printing sleeves, the Hoage patent proposed a printing sleeve formed of a laminated polymeric material reinforced with a woven fabric which was wrapped around a core to form the sleeve.

The printing sleeve of the Hoage patent can be relatively expensive to make and in some instances it may not expand as well as desired with low pressure air. Therefore, a need still exists for a cylindrically-shaped printing sleeve which is unitary and airtight, and which is readily expandable using a low pressure gas so that it can be easily mounted or dismounted on a printing cylinder.

BRIEF SUMMARY OF THE INVENTION

The present invention relates to a wound printing sleeve which meets the needs of the printing industry and overcomes the problems associated with prior art wound sleeves.

It also relates to a method of preparing such a printing sleeve.

The printing sleeve of the present invention comprises a cylindrical tube of polymeric material having a constant cross-sectional diameter. The polymeric material is reinforced with overlapping, closely touching windings of fibrous strands which extend in opposite directions. The resulting sleeve is readily axially mounted on, and dismounted from a conventional complementary shaped printing cylinder which also has a constant cross-sectional diameter by use of low pressure gas. The printing sleeve contracts to engage the printing cylinder when the expanding force is removed.

The term "low pressure" is intended to describe a pressure, at ambient temperature, of not more than about 100 psi. The use of low pressure gas is important since most production facilities do not have gas available at higher pressures and the use of higher pressure gas is subject to government regulation.

The printing sleeve of the present invention is readily fabricated by winding at least two fibrous strands of material impregnated with a polymeric thermosetting material in opposite directions at a definite wind angle on a cylindrical mandrel. The sleeve is then cured, trimmed and removed. The resulting printing sleeve is strong, durable, and airtight.

The printing sleeve of the present invention exhibits certain desired physical properties such as a flexural modulus of at least about $6\times10^5$ lbs/in$^2$ using ASTM D2412 and a suitable stiffness.

The printing sleeve of the present invention can be fabricated with a wall thickness substantially greater than conventional metal printing sleeves. Preferably, the wall thickness will be at least about 0.015", and usually at least about 0.040". Although sleeves of the present invention having thicker walls can be fabricated, the useful upper limit of wall thickness is about 0.120".

The foregoing and other objects, features and advantages of the invention will become more readily apparent from the description of the preferred embodiment and drawings.

DETAILED DESCRIPTION OF THE PREFERRED EMBODIMENT

Figure 1:
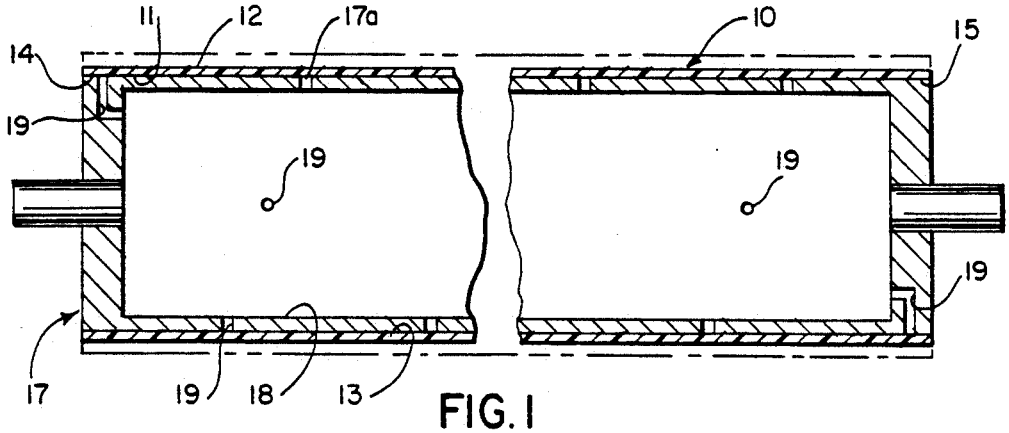
FIG. 1 is a perspective view of a printing sleeve of the present invention as mounted on a printing cylinder.
Figure 2:
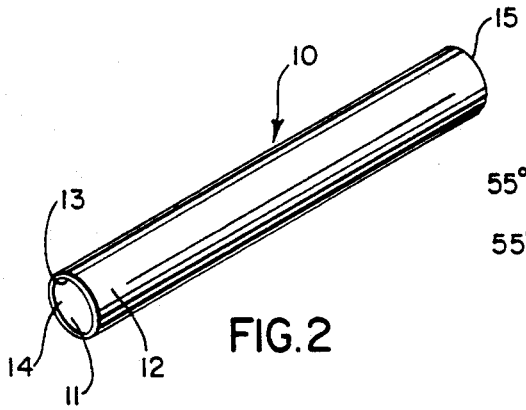
FIG. 2 is a perspective view of the cylindrically-shaped printing sleeve of FIG. 1.

In FIGS. 1 and 2 of the drawing, a cylindrically-shaped printing sleeve 10 is shown. As seen therein it has cylindrically-shaped inner and outer walls 11 and 12 which define a hollow inner chamber 13, and a pair of open ends, 14 and 15, respectively. In FIG. 1, sleeve 10 is shown mounted on a conventional printing cylinder 16.

Typically, the sleeve 10 will serve as a support for the application of flexographic printing plates (not shown), which are generally made of a flexible polymeric material. Any suitable indicia for printing onto a printing medium may be set on these printing plates. Alternatively, the outer wall 12 may itself be employed as a printing plate by engraving it using chemical or photochemical engraving techniques.

Still referring to FIG. 1, it can be seen that the printing sleeve 10 and the printing cylinder 17 are cylindrical and have a constant diameter. The outer wall 17*a* of the cylinder 17 actually is slightly larger in diameter than the inner wall 11 of the sleeve 10 so that the sleeve 10 will firmly and frictionally fit onto the cylinder 17.

As seen in FIG. 1, the cylinder 17 is hollow and has an interior chamber 18 which is used as a compressed air chamber. A plurality of spaced-apart, radially-extending apertures 19 are provided by which air from the chamber 18 may exit to or expand the sleeve 10 during mounting and dismounting operations. The air is introduced into the chamber 18 under pressure to expand the sleeve 10 as shown in dotted lines in FIG. 1.

Figure 3:
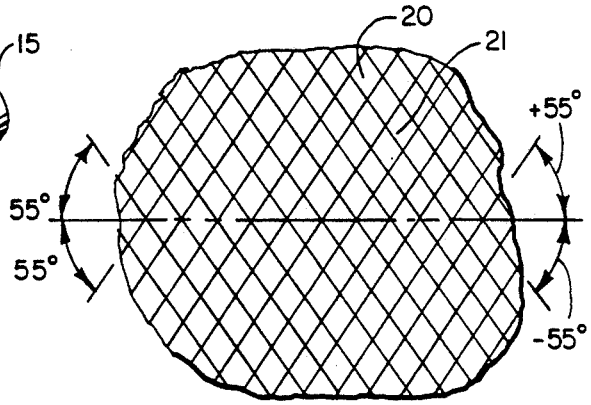
FIG. 3 is a sectional view of the printing sleeve of FIG. 2.
Figure 4:
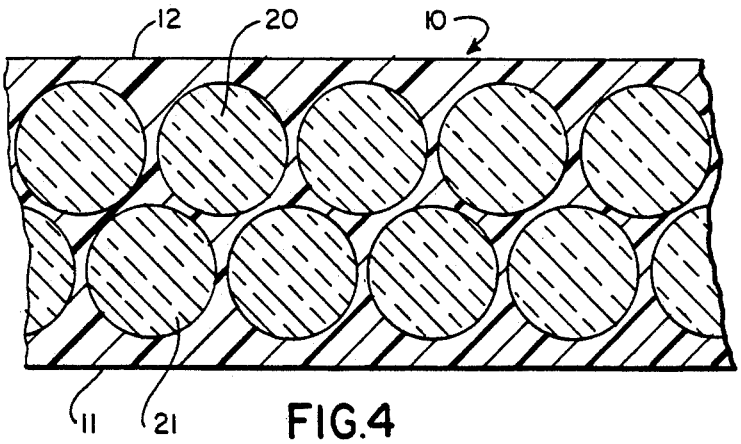
FIG. 4 is a schematic view showing the overlapping windings and the wind angles.

The preferred method of making a printing sleeve of the present invention comprises first applying a release agent, such as polyvinyl alcohol and the like, onto the outer wall of a cylindrical mandrel. The mandrel is about 0.006"–0.011" smaller in outer diameter than the printing cylinder for which the sleeve is intended. The release agent is used to allow the finished sleeve to be readily removed from the mandrel after the process has been completed. Next, fibrous strands of glass, graphite, aramid or other filaments are dipped into a bath of a suitable thermosetting resin which can contain a curing agent, if necessary. The fibrous strands are worked by passing them over and under stationary bars in the bath. At the end of the bath, the wetted strands are passed through squeeze bars or rollers to remove the excess resin. The resin content of the fibrous strands exiting the bath is about 50% by weight. The desired level is about 15%–30% by weight. This excess resin is carried onto the winding mandrel and is squeezed out after two or three winding layers. A tension of 0.5–5.0 pounds per strand of fiber is used. The resin wetted strands are wound about the axis of the mandrel at a wind angle of about 45° so that each new turn touches the previous turn of fiber. A sleeve construction comprised of two helical windings of strands 20 and 21 at a wind angle of about 45° is shown in FIGS. 3 and 4.

The printing sleeve is built to a thickness of 0.050"–0.070" and the wound part is cured on the mandrel. During the curing in an oven the mandrel is rotated while the resin bonds together with the fibers and the resin forms molecular chains that are crosslinked to form a non-permeable structure. Depending upon the resin, the curing may take about 2 hours and it may be advantageous to post cure the sleeve, e.g., at 170° F. for 30 minutes. Once the printing sleeve is cured, it can be ground to a constant cross-sectional diameter to 0.001" and a thickness of 0.020"–0.050" depending on the resin and fibers used and the wind angle.

If desired a printing cylinder also can be used as the winding mandrel.

It has been discovered that a wind angle of 40° is an angle at which the sleeve will expand diametrically without affecting its length. A wind angle of about 45° is preferred because the resulting sleeve is somewhat easier to expand diametrically than when the wind angle is 40°. The term "about 40°" as used herein is intended to cover wind angles of about 35° to about 55° which are substantially equivalent to the theoretical wind angle of 40°.

It has been demonstrated by tests on sleeves wound at angles different than 40°, that under low pressure, that the strain results in a reduction of diameter and a growth in the length or that the sleeve may grow in diameter and reduce in length depending upon the wind angle used.

The polymeric resin used in the present invention can be any suitable thermosetting resin such as an epoxy resin or a polyester resin. The preferred resin is an epoxy resin sold by Shell under the tradename EPON A 26. The preferred resin, when cured, has a high degree of toughness, chemical resistance, impact resistance and a high level of tensile strength.

It will be readily apparent to those skilled in the art that the invention can be modified in arrangement and detail without departing from the spirit and scope of the invention. Therefore any and all modifications coming within the spirit and scope of the invention are to be included in the claims.

I claim:

1. An expandable printing sleeve which is axially mountable on and dismountable from a printing cylinder and which comprises a substantially non-permeable cylindrical tube having a cross-sectional diameter, the tube having a wall with a thickness of about 0.015 to about 0.120 inches and a flexural modulus of at least about $6\times10^5$ lbs/in$^2$, said wall of the tube comprising at least one individual layer of polymeric thermosettting material reinforced by first and second fibrous strands, said first fibrous strand being wound a plurality of turns around a cylindrical mandrel at a positive wind angle of about 35° to about 55° with respect to a central axis of the cylindrical mandrel to form a first helical coil within the layer of polymeric thermosetting material, and said second fibrous strand being wound a plurality of turns around the cylindrical mandrel at a negative wind angle of about 35° to about 55° with respect to the central axis of the cylindrical mandrel to form a second helical coil within the layer of polymeric thermosetting material, one of the first and second helical coils being formed in non-interwoven fashion around the other of the first and second helical coils within the individual layer of polymeric thermosetting material.

2. The printing sleeve of claim 1 in which the polymeric thermosetting material is an epoxy resin.

3. The printing sleeve of claim 1 in which the fibrous strands are glass filaments.

4. An expandable printing sleeve which is axially mountable on and dismountable from a printing cylinder, the printing sleeve comprising a substantially non-permeable cylindrical tube having a wall with a cross-sectional diameter thickness of about 0.015 to about 0.120 inches and a flexural modulus of at least about $6\times10^5$ lbs/in$^2$, said wall of the tube being made by the method comprising:

winding a first fibrous strand of resin-wetted material a plurality of turns around a cylindrical mandrel at a positive wind angle of about 35° to about 55° with respect to a central axis of the cylindrical mandrel;

winding a second fibrous strand of resin-wetted material a plurality of turns around the cylindrical mandrel at a negative wind angle of about 35° to about 55° with respect to the central axis of the cylindrical mandrel;

wherein one of the first and second fibrous strands is wound around the other of the first and second fibrous strands in non-interwoven fashion to form two helical coils; and curing the first and second fibrous strands of resin-wetted material to form an individual layer of polymeric thermosetting material reinforced by the first and second non-interwoven fibrous strands.

* * * * *